US007376990B2

(12) United States Patent
Gooddine

(10) Patent No.: US 7,376,990 B2
(45) Date of Patent: May 27, 2008

(54) SHAM FOR A TRAVEL PILLOW

(76) Inventor: Richard Gooddine, 2995 Tributary Way, Decatur, GA (US) 30034

( * ) Notice: Subject to any disclaimer, the term of this patent is extended or adjusted under 35 U.S.C. 154(b) by 15 days.

(21) Appl. No.: 11/487,633

(22) Filed: Jul. 17, 2006

(65) Prior Publication Data

US 2007/0033734 A1 Feb. 15, 2007

Related U.S. Application Data

(60) Provisional application No. 60/706,292, filed on Aug. 9, 2005.

(51) Int. Cl.
*A47G 9/00* (2006.01)

(52) U.S. Cl. ..... 5/490; 5/491; 383/4; 383/16

(58) Field of Classification Search ..... 5/690, 5/691, 692, 636, 653, 490, 491, 492; 383/4, 383/16

See application file for complete search history.

(56) References Cited

U.S. PATENT DOCUMENTS 830,970 A * 9/1906 Cary ..... 5/640
2,291,806 A * 8/1942 Diehl ..... 190/8
D283,771 S * 5/1986 Howard ..... D6/596
5,157,799 A * 10/1992 Aird ..... 5/490

* cited by examiner

*Primary Examiner*—Alexander Grosz
(74) *Attorney, Agent, or Firm*—John L. James

(57) ABSTRACT

A sham for a travel pillow has a bottom panel, a left panel with three edges sewn to the bottom panel forming a left pocket, and a right panel with three edges sewn to the bottom panel forming a right pocket. The right panel overlaps the left panel form a single pillow pocket. A left handle is attached to the left side edge portion of the bottom panel and a right handle is attached to the right side edge portion of the bottom panel. The right side edge portion of the bottom panel folds over the left side edge portion of the bottom panel to thereby bring the left and right handles together for carrying the pillow sham. A zipper double stitched to the left and right side edges fastens the right side edge portion of the bottom panel to left side edge portion of the bottom panel while the right side edge portion of the bottom panel is folded over the left side edge portion of the bottom panel.

7 Claims, 5 Drawing Sheets

SHAM FOR A TRAVEL PILLOW

CROSS-REFERENCE TO RELATED APPLICATIONS

This application is a continuation-in-part of provisional application Ser. No. 60/706,292 filed Aug. 9, 2005 entitled Combination Pillow Sham/Pillow Tote Bag.

TECHNICAL FIELD OF THE INVENTION

This invention relates generally to a pillow sham, and, more particularly, to a pillow sham suitable for a travel pillow.

BACKGROUND OF THE INVENTION

Pillow shams have been used to cover and decorate a conventional bed pillow. When traveling, many people prefer to carry a their personal bed pillow. They are accustomed to their personal pillow covered with a conventional pillow case. Regular bed pillows are generally larger in length and width than a travel pillow, such as those used on trains, buses and airplanes. Carrying a conventional bed pillow is often difficult because it is bulky and difficult to hold. Accordingly, it will be appreciated that it would be highly desirable to have a device that uses a personal bed pillow and that is easy to carry.

SUMMARY OF THE INVENTION

The present invention is directed to overcoming one or more of the problems set forth above. Briefly summarized, according to one aspect of the present the invention, a pillow sham comprises bottom, left and right panels. The bottom panel has opposed top and bottom edge portions, opposed left and right side edge portions and a middle portion disposed between the edge portions. The left panel has a top edge portion attached to the top edge portion of the bottom panel, a left edge portion attached to the left edge portion of the bottom panel and a bottom edge portion attached to the bottom edge portion of the bottom panel. The left panel extends from the left edge portion of the bottom panel to the middle portion of the bottom panel forming a left pocket. A right panel has a top edge portion attached to the top edge portion of the bottom panel, a right edge portion attached to the right edge portion of the bottom panel and a bottom edge portion attached to the bottom edge portion of the bottom panel. The right panel extends from the right edge portion of the bottom panel to the middle portion of the bottom panel forming a right pocket. A left end portion of the right panel overlaps a right end portion of the left panel forming a single pocket adapted to removably receive a pillow. A left handle is attached to the left side edge portion of the bottom panel, and a right handle is attached to the right side edge portion of the bottom panel. The right side edge portion of the bottom panel folds over the left side edge portion of the bottom panel thereby bringing the left and right handles together for carrying the pillow sham. A fastening device fastens the right side edge portion of the bottom panel to left side edge portion of the bottom panel while the right side edge portion of the bottom panel is folded over the left side edge portion of the bottom panel.

The handles and fastening device facilitate folding the sham with a pillow inside into a compact bag for transport or storage. Constructing the sham of washable fabric promotes hygiene.

According to another aspect of the present the invention, the fastening device for the pillow sham comprises a two part zipper having a first part and a detached second part. The first part is disposed between the left edge portion of the bottom panel and the left edge portion of the left panel and fastened therebetween with a left double stitch. The second part is disposed between the right edge portion of the bottom panel and the right edge portion of the right panel and fastened therebetween with a right double stitch.

The double stitching keeps the zipper from pulling away from the fabric when a large pillow is used that strains the zipper.

These and other aspects, objects, features and advantages of the present invention will be more clearly understood and appreciated from a review of the following detailed description of the preferred embodiments and appended claims, and by reference to the accompanying drawings

DETAILED DESCRIPTION OF THE PREFERRED EMBODIMENTS

Figure 1:
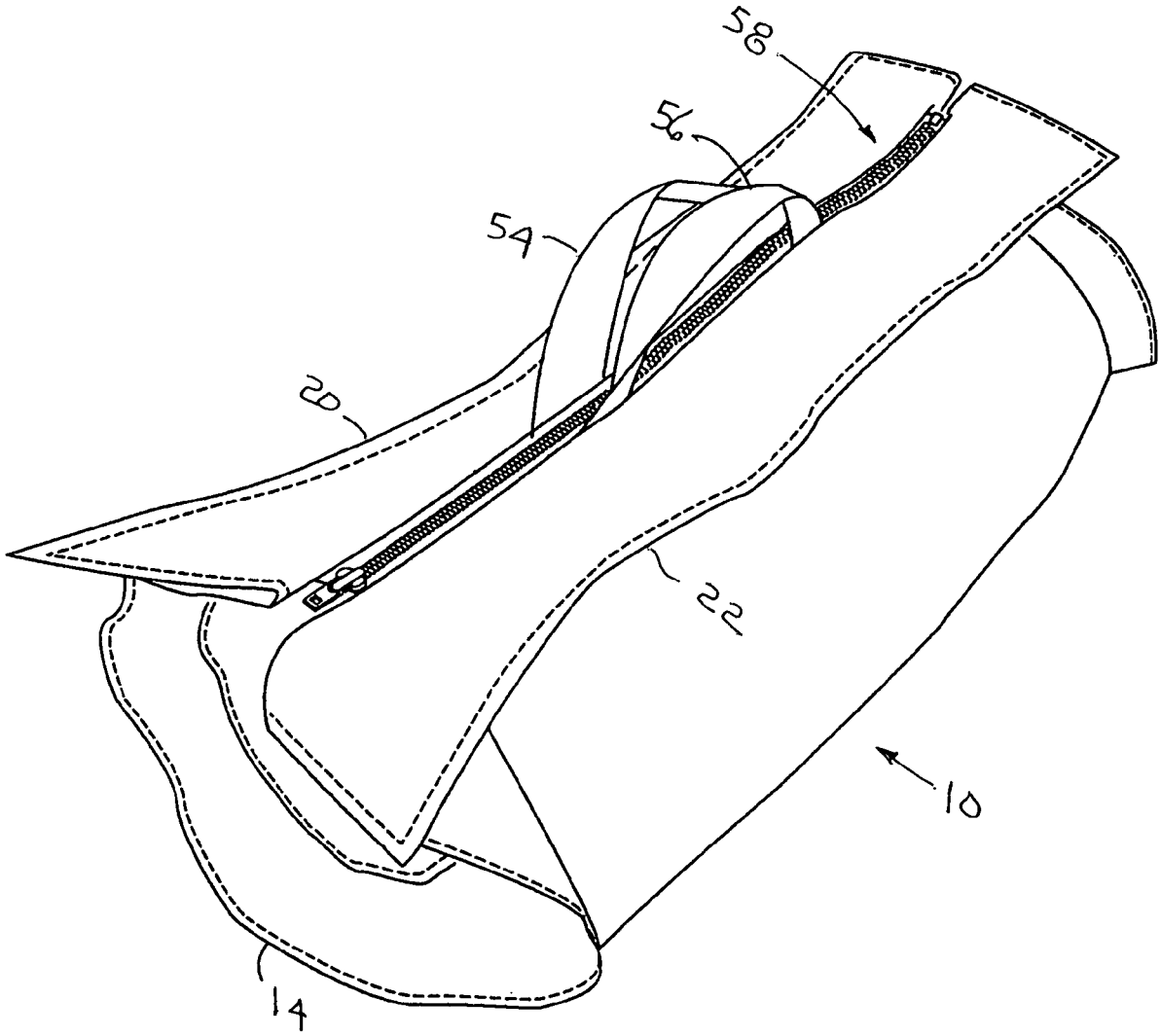
FIG. 1 is a perspective view of a preferred embodiment of a pillow sham containing a travel pillow folded and zipped forming a travel bag according to the present invention.
Figure 2:
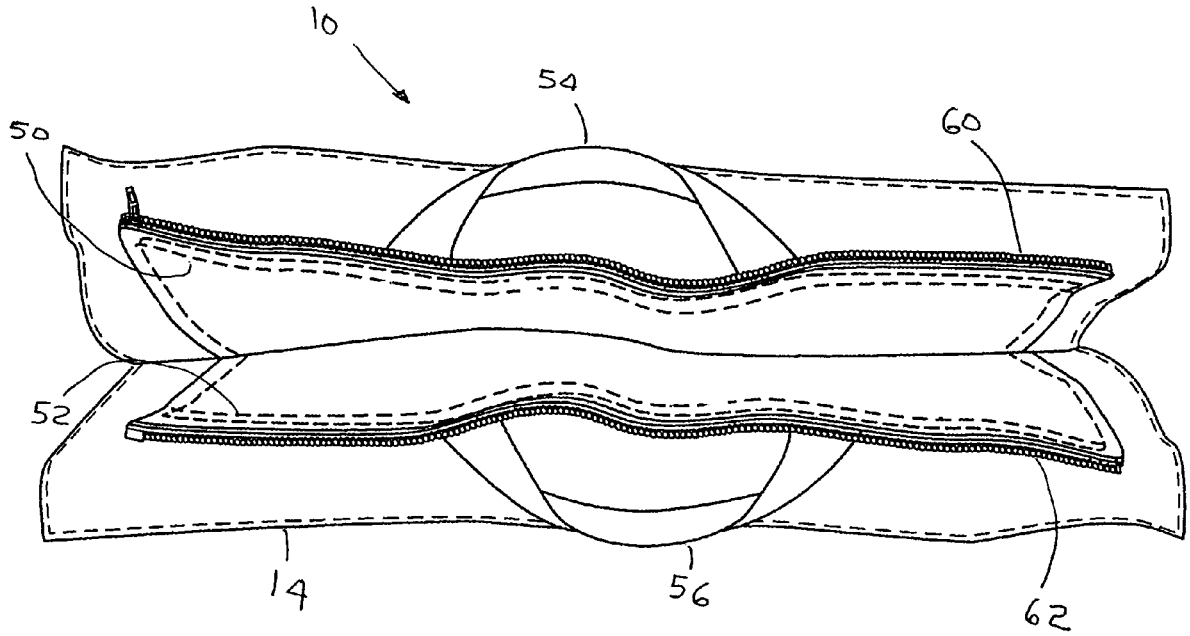
FIG. 2 is a diagrammatic top view of the folded pillow sham of FIG. 1 with the bag unzipped.
Figure 3:
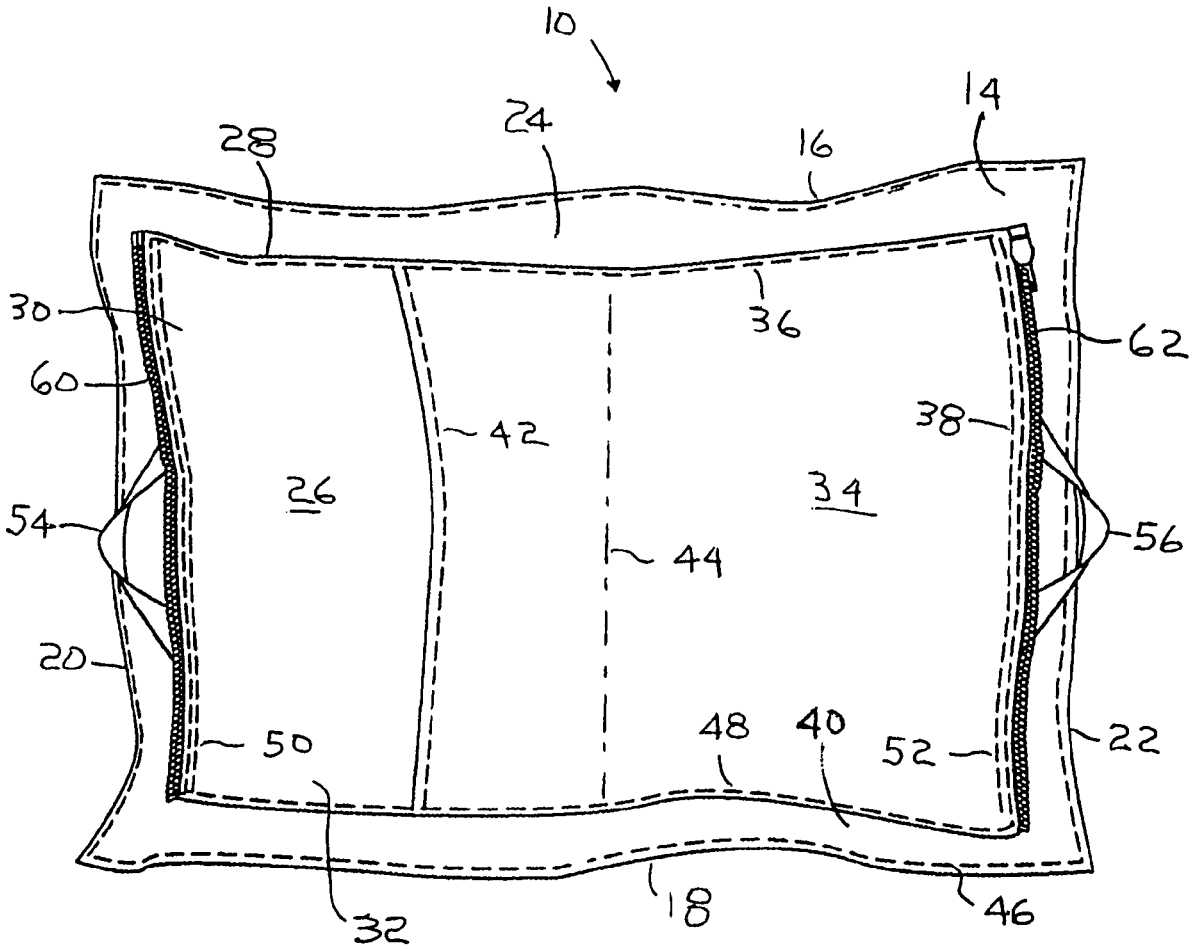
FIG. 3 is diagrammatic top view of the pillow sham of FIG. 1 unzipped and unfolded.
Figure 4:
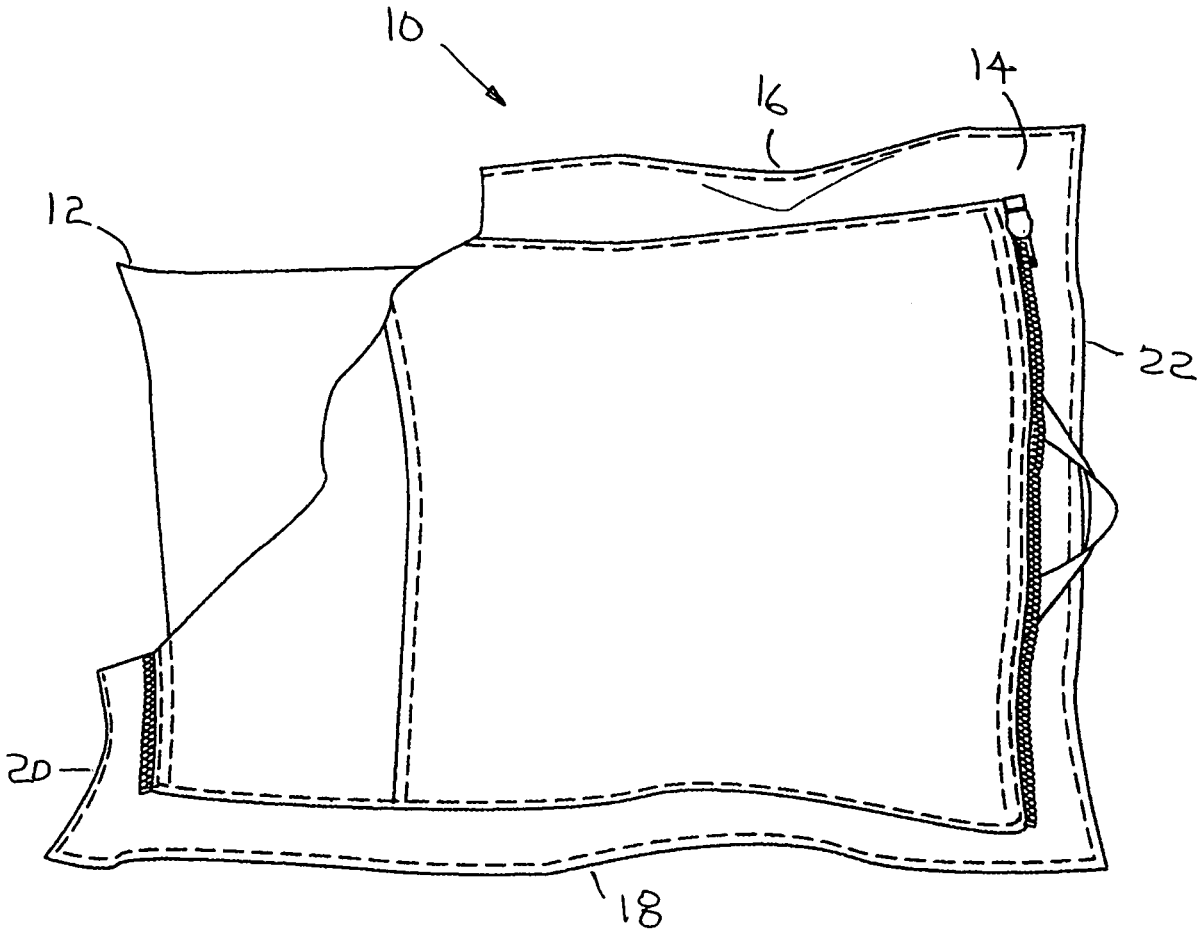
FIG. 4 is diagrammatic top view with a section cut away of the pillow sham of FIG. 1 unzipped and unfolded.
Figure 5:
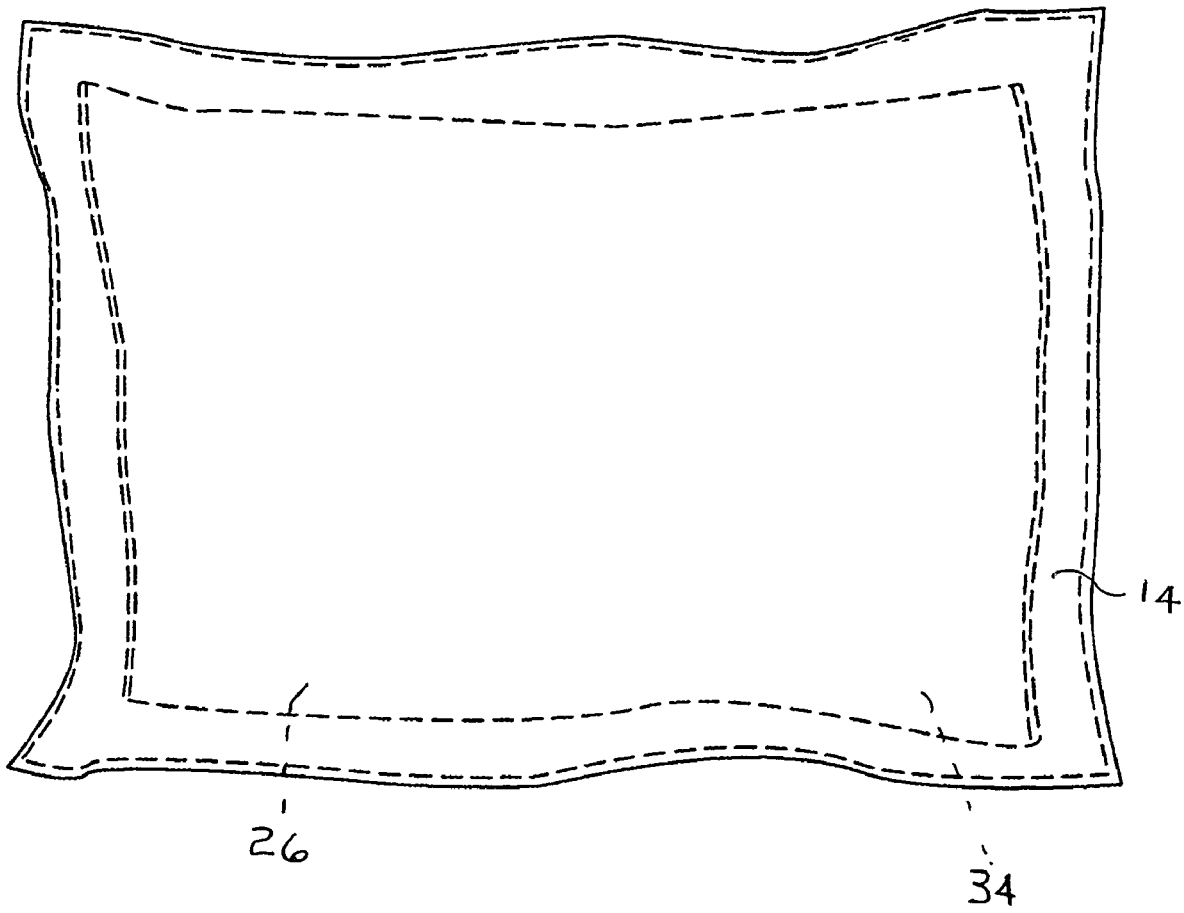
FIG. 5 is a diagrammatic bottom view of the pillow sham of FIG. 1 unzipped and unfolded.

Referring to FIGS. 1-5, a pillow sham 10 for a personal bed pillow 12 for travel use folds, with pillow 12 inside, to convert to a carrying bag. Pillow sham 10 has a bottom panel 14 with opposed top and bottom edge portions 16, 18, opposed left and right side edge portions 20, 22 and a middle portion 24 disposed between the edge portions 16, 18, 20, 22. Pillow sham 10 is preferably constructed of ordinary fabric but other flexible material can be used, such as materials used for soft luggage and garment bags. A washable fabric is preferred for hygienic purposes.

Pillow sham 10 has a left panel 26 with a top edge portion 28 attached to top edge portion 16 of bottom panel 14, a left edge portion 30 attached to left edge portion 20 of bottom panel 14, and a bottom edge portion 32 attached to bottom edge portion 18 of bottom panel 14. Left panel 26 extends from left edge portion 20 of bottom panel 14 to middle portion 24 of bottom panel 14 forming a left pocket.

Pillow sham 10 also has a right panel 34 with a top edge portion 36 attached to top edge portion 16 of bottom panel 14, a right edge portion 38 attached to right edge portion 22 of bottom panel 14, and a bottom edge portion 40 attached to bottom edge portion 18 of bottom panel 14. The right panel 34 extends from right edge portion 22 of bottom panel 14 to middle portion 24 of bottom panel 14 forming a right pocket. A left end portion 42 of right panel 34 overlaps a right end portion 44 of left panel 26 forming a single pocket adapted to removably receive pillow 12.

Where the pillow sham 10 is constructed of fabric, bottom panel 14 preferably has single stitch 46 about the periphery formed by opposed top and bottom edge portions 16, 18, and opposed left and right side edge portions 20, 22. Single stitch 46 forms a hem to retard unraveling of the fabric and provide a finished appearance. Similarly, left and right panels have a single stitch 48 about the entire periphery and double stitches 50, 52 at the left and right end portions.

A left handle 54 is attached to left side edge portion 20 of the bottom panel 14, or, more preferably, between bottom panel 14 and left panel 26. Left handle 54 is preferably secured by double stitch 50. Similarly, a right handle 56 is attached to right side edge portion 34 of bottom panel 14, or, more preferably, between bottom panel 14 and right panel 34. The right side edge portion 22 of bottom panel 14 folds over left side edge portion 26 of bottom panel 14 to thereby bring the left and right handles 54, 56 together for carrying the pillow sham. When folded, the length is decreased creating a more compact travel pillow.

Fastening means, such as zipper assembly 58, is provided for fastening the right side edge portion 22 of the bottom panel 14 to left side edge portion 26 of the bottom panel 14 while the right side edge portion 22 of the bottom panel 14 is folded over the left side edge portion 26 of the bottom panel 14. Zipper assembly 58 is preferably a two part zipper having a first or left part 60 and a separate second or right part 62. Left zipper part 60 is fastened to left edge portion 20 of the bottom panel 14, or, more preferably, between bottom panel 14 and left panel 26 and secured by double stitch 50. Similarly, right zipper part 62 is fastened to right edge portion 22 of bottom panel 14, or, more preferably, between bottom panel 14 and right panel 34 and secured by double stitch 52.

It can now be appreciated that a pillow sham for a travel pillow uses a personal bed pillow. One side of the sham folds over the other side with the pillow inserted to form a more compact bundle for carrying or storing. A zipper is double stitched to ends of the sham so that, when the sham is folded, the sham can be zipped closed forming a tote bag for easy carrying. Handles are also double stitched to facilitate handling, While the invention has been described with particular reference to the preferred embodiments, it will be understood by those skilled in the art that various changes may be made and equivalents may be substituted for elements of the preferred embodiments without departing from invention. For example, while fabric of natural fibers are preferred for the sham because of their absorption, fabric of absorbent synthetic fibers can be used effectively.

As is evident from the foregoing description, certain aspects of the invention are not limited to the particular details of the examples illustrated, and it is therefore contemplated that other modifications and applications will occur to those skilled in the art. For example, while a zipper is preferred, a hook and loop fastening system, or other fastener can be used. Also, while a personal bed pillow is contemplated for use with the sham, any pillow can be used. It is accordingly intended that the claims shall cover all such modifications and applications as do not depart from the true spirit and scope of the invention.

ELEMENT LIST

10 pillow sham
12 bed pillow
14 bottom panel
16 top edge portion
18 bottom edge portion
20 left side edge portion
22 right side edge portion
24 middle portion
26 left panel
28 top edge portion
30 left edge portion
32 bottom edge portion
34 right panel
36 top edge portion
38 right edge portion
40 bottom edge portion
42 left end portion
44 right end portion
46 bottom panel single stitch
48 left and right panels single stitch
50 left double stitch
52 right double stitch
54 left handle
56 right handle
58 zipper assembly
60 left zipper part
62 right zipper part

What is claimed is:

1. A pillow sham, comprising:

a bottom panel having opposed top and bottom edge portions, opposed left and right side edge portions and a middle portion disposed between said edge portions;

a left panel having a top edge portion attached to said top edge portion of said bottom panel, a left edge portion attached to said left edge portion of said bottom panel and a bottom edge portion attached to said bottom edge portion of said bottom panel, said left panel extending from said left edge portion of said bottom panel to said middle portion of said bottom panel forming a left pocket;

a right panel having a top edge portion attached to said top edge portion of said bottom panel, a right edge potion attached to said right edge portion of said bottom panel and a bottom edge portion attached to said bottom edge portion of said bottom panel, said right panel extending from said right edge portion of said bottom panel to said middle portion of said bottom panel forming a right pocket, a left end portion of said right panel overlapping a right end portion of said left panel forming a single pocket adapted to removably receive a pillow;

a left handle attached to said left side edge portion of said bottom panel;

a right handle attached to said right side edge portion of said bottom panel, said right side edge portion of said bottom panel folding over said left side edge portion of said bottom panel to thereby bring said left and right handles together for carrying said pillow sham; and fastening means for fastening said right side edge portion of said bottom panel to left side edge portion of said bottom panel while said right side edge portion of said bottom panel is folded over said left side edge portion of said bottom panel.

2. A pillow sham, as set forth in claim 1, wherein said fastening means includes a two part zipper having a first part and a separate second part, said first part being fastened to said left edge portion of said bottom panel and said second part being fastened to said right edge portion of said bottom panel.

3. A pillow sham, as set forth in claim 1, wherein said fastening means includes a two part zipper having a first part and a separate second part, said first part being fastened between said left edge portion of said bottom panel and said left edge portion of said left panel, said second part being fastened between said right edge portion of said bottom panel and said right edge portion of said right panel.

4. A pillow sham, as set forth in claim 1, wherein said bottom left and right panels are fabric panels and wherein said fastening means includes a two part zipper having a first part and a separate second part, said first part being stitched with a left double stitch between said left edge portion of said bottom panel and said left edge portion of said left panel, said second part being stitched with a right double stitch between said right edge portion of said bottom panel.

5. A pillow sham, as set forth in claim 4 wherein said left handle is disposed between said left edge portion of said bottom panel and said left edge portion of said left panel and fastened therebetween with said left double stitch, and wherein said right handle is disposed between said right edge portion of said bottom panel and said right edge portion of said right panel and fastened therebetween with said right double stitch.

6. A pillow sham, comprising:

a bottom fabric panel having top, bottom, left and right edge portions and a middle portion disposed between said edge portions;

a left fabric panel having a top edge portion attached to said top edge portion of said bottom panel, a left edge portion attached to said left edge portion of said bottom panel and a bottom edge portion attached to said bottom edge portion of said bottom panel, said left panel extending from said left edge portion of said bottom panel to said middle portion of said bottom panel forming a left pocket;

a right fabric panel having a top edge portion attached to said top edge portion of said bottom panel, a right edge portion attached to said right edge portion of said bottom panel and a bottom edge portion attached to said bottom edge portion of said bottom panel, said right panel extending from said right edge portion of said bottom panel to said middle portion of said bottom panel forming a right pocket, a left end portion of said right panel overlapping a right end portion of said left panel forming a single pocket adapted to removably receive a pillow;

a left handle attached to said left side edge portion of said bottom panel;

a right handle attached to said right side edge portion of said bottom panel, said right side edge portion of said bottom panel folding over said left side edge portion of said bottom panel to thereby bring said left and right handles together for carrying said pillow sham; and a two part zipper having a first part and a detached second part, said first part being disposed between said left edge portion of said bottom panel and said left edge portion of said left panel and fastened therebetween with a left double stitch, said second part being disposed between said right edge portion of said bottom panel and said right edge portion of said right panel and fastened therebetween with a right double stitch.

7. A pillow sham, as set forth in claim 6 wherein said left handle is disposed between said left edge portion of said bottom panel and said left edge portion of said left panel and fastened therebetween with said left double stitch, and wherein said right handle is disposed between said right edge portion of said bottom panel and said right edge portion of said right panel and fastened therebetween with right said double stitch.

* * * * *